US005442946A

United States Patent [19]

Yokoo et al.

[11] Patent Number: 5,442,946

[45] Date of Patent: Aug. 22, 1995

[54] STEEL STOCK SHAPING APPARATUS PROVIDED WITH GUIDE APPARATUS AND STEEL STOCK SHAPING PROCESS

[75] Inventors: Yoshiki Yokoo; Tadanori Teraoka, both of Tokai, Japan

[73] Assignee: Aichi Steel Works, Ltd., Tokai, Japan

[21] Appl. No.: 81,381

[22] PCT Filed: Dec. 26, 1991

[86] PCT No.: PCT/JP91/01806

§ 371 Date: Jun. 29, 1993

§ 102(e) Date: Jun. 29, 1993

[87] PCT Pub. No.: WO93/09894

PCT Pub. Date: May 27, 1993

[30] Foreign Application Priority Data

Nov. 14, 1991 [JP] Japan ..... 3-299105

[51] Int. Cl.[6] ..... B21B 39/16

[52] U.S. Cl. ..... 72/235; 72/250

[58] Field of Search ..... 72/235, 250, 428, 201; 226/196, 199

[56] References Cited

U.S. PATENT DOCUMENTS

| | | | |
|---|---|---|---|
| 1,562,488 | 11/1925 | Baehr | 72/250 |
| 2,789,450 | 4/1957 | Properzi | 72/235 |
| 2,987,496 | 6/1961 | Raudebaugh | 72/428 |
| 3,060,773 | 10/1962 | Stroms | 72/428 |
| 4,450,702 | 5/1984 | Larson et al. | 72/250 |
| 4,488,710 | 12/1984 | Greenburger | 72/201 |
| 4,776,200 | 10/1988 | Fabbri | 72/428 |
| 4,907,438 | 3/1990 | Sasaki et al. | 72/235 |

FOREIGN PATENT DOCUMENTS

| | | | |
|---|---|---|---|
| 718128 | 12/1932 | Japan . | |
| 38-106518 | 7/1963 | Japan . | |
| 51-146362 | 12/1976 | Japan . | |
| 55-17660 | 2/1980 | Japan . | |
| 57-124520 | 8/1982 | Japan . | |
| 59-39435 | 3/1984 | Japan . | |
| 60-92020 | 5/1985 | Japan . | |
| 60-186911 | 12/1985 | Japan . | |
| 0224403 | 10/1987 | Japan | 72/235 |
| 63-101104 | 7/1988 | Japan . | |

*Primary Examiner*—Lowell A. Larson
*Assistant Examiner*—Thomas C. Schoeffler
*Attorney, Agent, or Firm*—Jacobson, Price, Holman & Stern

[57] ABSTRACT

The present steel stock shaping apparatus includes a rolling apparatus which includes a plural set of 3-roll apparatuses disposed along a steel stock transferring direction in series, a precision rolling 3-roll type sizing apparatus 1 which is adapted for shaping, a carbon-material-made guide apparatus 5 which has a guide bore 50 adapted for guiding a sized steel stock "W" to a subsequent process. The inner diameter of the guide bore 50 is set so that it is larger than the outer diameter of the steel stock "W" having a circle cross section by 0.1 to 8 mm, and accordingly the clearance between an inner wall surface 55 of the guide bore 50 and the steel stock "W" is made extremely small. In addition, the axial length of the guide bore 50 is set longer, and accordingly, when a bending at the leading end of the steel stock "W" enters the guide bore 50, the bending is corrected by the inner wall surface 55 of the guide bore 50. As a result, it is possible to relieve or avoid a letter "S" shape bending which occurs when the steel stock "W" is depressed lightly with the 3-roll apparatuses.

13 Claims, 11 Drawing Sheets

STEEL STOCK SHAPING APPARATUS PROVIDED WITH GUIDE APPARATUS AND STEEL STOCK SHAPING PROCESS

TECHNICAL FIELD

The present invention relates to a sizing treatment for sizing an outer peripheral of a steel stock comprising general-purpose steel, stainless steel, special-purpose steel, or the like, and having a round shape, a hexagonal shape, or the like in a transverse cross section, sizing treatment which is adapted for upgrading the dimensional accuracy, the roundness, or the like of the steel stock. In particular, the present invention relates to a steel stock shaping apparatus and a steel stock shaping process which are appropriate for precision rolling, ultra precision rolling, or the like.

BACKGROUND ART

In industries, it is getting required to further upgrade the dimensional accuracy, the roundness, or the like of bar stocks, wire stocks, or the like, having circle shapes in their transverse cross sections. For example, in the case of a steel stock having a diameter of about 50 mm, it is required that the steel stock has a dimensional tolerance value, a value of the difference between the maximum diameter and the minimum diameter in the same cross section, or the like, in a range of plus/minus 0.70 to 0.80 mm in the conventional Japanese Industrial Standard (hereinafter simply referred to as "JIS"). However, it has been required recently that the steel stock has the dimensional tolerance value, the value of the difference, or the like, falling in the the higher accuracy, e.g., in a range of plus/minus 0.10 to 0.20 mm.

Accordingly, instead of the conventionally employed HV (i.e., horizontal and vertical) type roll apparatus for rolling in which two rolls are disposed vertically, the present applicant introduced an apparatus which is adapted for precision rolling or ultra precision rolling steel stocks into its manufacturing line. The precision or ultra precision rolling apparatus comprises a plural set of 3-roll apparatuses which are disposed in series in a steel stock transferring direction and which include 3 rolling rolls. The 3 rolling rolls have a caliber groove surface going therearound in a ring shape, and they are disposed at equal intervals in a circumferential direction of a steel stock. With this apparatus, it is possible to make the dimensional accuracy, the roundness, or the like, of the steel stock further accurate.

In this apparatus adapted for precisely or ultra-precisely rolling the steel stock, there is installed a sizing apparatus which is adapted for shaping at the final process of the rolling process. The sizing apparatus also comprises a plural set of 3-roll apparatuses which include 3 sizing rolls. Likewise, the 3 sizing rolls have a caliber groove surface going therearound in a ring shape, and they are disposed at equal intervals in the circumferential direction of the steel stock. Likewise, in the sizing apparatus, it is needed to dispose a plural set of the 3-roll apparatuses in series in the steel stock transferring direction. Moreover, on an outlet side of the sizing apparatus, it is necessary to install a guide apparatus having a guide bore in order to guide the steel stock, which has been subjected to the sizing and which has been discharged from the outlet side of the sizing apparatus, to a subsequent process.

In the sizing apparatus which is employed in the final process of the precision or the ultra precision rolling apparatus, the depressing rate reduction is extremely small during the sizing. Consequently, there is provided an advantage that the steel stock sized with the sizing apparatus comes to exhibit the dimensional accuracy, the roundness, or the like in high precision. However, there arises a problem that the leading end of the thusly sized steel stock is likely to bend in a letter "S" shape, usually in a letter "S" shape which is bent 3-dimensionally. When the depressing rate is increased during the sizing with the 3-roll apparatuses, the steel stock comes to be depressed heavily by heavily bringing all of the caliber groove surfaces of the 3 sizing rolls constituting the 3-apparatuses into contact with the outer peripheral surface of the steel stock, and accordingly the depressing is developed to the central portions of the steel stock. As a result, a balance is attained in the depressing, and the letter "S" shaped bending is relieved. However, the steel stock hardly comes to exhibit the dimensional accuracy, the roundness, or the like in high precision. Thus, the heavy depressing with the sizing apparatus does not conform to the precision or the ultra precision rolling.

When the leading end of the steel stock is bent in a letter "S" shape as aforementioned, it is troublesome to transfer the steel stock to a subsequent process. Moreover, the leading end bent in a letter "S" shape can hardly be a product in view of quality, and it should be cut accordingly. Thus, the bent leading end causes a limit in the improvement of material loss.

It is believed that the "S" shaped bending is caused as follows. Namely, in the sizing apparatus employed in the final process of the precision or the ultra precision rolling apparatus, the depressing rate is adjusted to an extremely small value during the sizing in order to keep the dimensional accuracy, the roundness, or the like, of the steel stock high. Consequently, in the final 3-apparatus of a plural set of the 3-roll apparatuses constituting the sizing apparatus, e.g., the 3-roll apparatus disposed most adjacent to the outlet side of the sizing apparatus, there is a sizing roll whose caliber groove surface is heavily brought into contact with the steel stock, and there are sizing rolls whose caliber surfaces are weakly brought into contact with the steel stock. With this arrangement, the sizing roller whose caliber groove surface is heavily brought into contact with the steel stock works to extend the surface of the steel stock, and the sizing rollers whose caliber groove surfaces are weakly brought into contact with the steel stock do not work to extend the surface of the steel stock and their depressing do not reach the central portions of the steel stock. As a result, the depressing balance to be ensured in the 3-roll apparatus is likely to collapse at the leading end of the steel stock. When the depressing balance is collapsed in this way, the surfaces which have been heavily brought into with each other vary their curvature directions subsequently so as to avoid the collapsed depressing balance, and they vary their curvature directions until the other balance is attained. Consequently, it is believed that the steel stock is bent in a letter "J" shape at the leading end at first, and that the steel stock is bent in the letter "S" shape eventually.

For reference, there have been disclosures on apparatuses for guiding steel stocks so far. For example, Japanese Unexamined Utility Model Application No. 106,518/1988 discloses a steel stock guide apparatus in which a front member of a nozzle is formed of ceramics and a rear member of the nozzle is formed of metal, and Japanese Utility Model Application No. 192,467/1986 discloses a steel stock guide apparatus which comprises an outer layer including metal and an inner layer including ceramics, whereby enhancing the seizure resistance and the wear resistance. However, although there is provided an advantageous effect that the steel stock can be guided to a subsequent process with these steel stock guide apparatuses, no effect on "S" shape bending reduction is expected therefrom.

The present invention has been developed in view of the "S" shape bending problems which inherently occur when the sizing operation is carried out with the above-described 3-roll type sizing apparatus so as to achieve the high accuracy. It is therefore an object of the present invention to provide a steel stock shaping apparatus, especially a sizing apparatus, and a steel stock shaping process which enable to relieve or avoid the "S" shape bending occurring at a leading end of a steel stock.

DISCLOSURE OF INVENTION

The present inventors have carried out a research on the steel stock shaping with the 3-roll type sizing apparatus extensively. As a result, when the present inventors guided a steel stock with a guide bore of a guide apparatus which is installed to an outlet side of the sizing apparatus, they noticed that the "S" shape bending could be reduced by forcibly applying an external force to a leading end of a steel stock with an inner wall surface of a guide bore during an early period when the "J" shape bending was about to occur. Further, they verified this finding by an experiment.

Namely, in order to apply the external force to the steel stock in the guide bore, an external force can be acted on the steel stock in the centripetal direction with the inner wall surface of the guide bore. If such is the case, there are two external force application forms available. The first form is an application of an external force to the leading end of the steel stock in either one of the steel stock centripetal directions, and the second form is an application of external forces acting opposite to each other to the steel stock in the steel stock centripetal directions.

Specifically speaking, let us consider an "S" shape bending, as illustrated in FIG. 1, which occurs at a leading end of a steel stock "W" during sizing with a sizing apparatus. Let a distance from a leading end "WO" of the steel stock "W" to a first bending "W1" be "L1" in a steel stock transferring direction, a bending amount of the first bending "W1" be "A," a distance from the leading end "WO" of the steel stock "W" to a terminal end of a second bending "W2" be "L2" in the steel stock transferring direction, and a bending amount of the second bending "W2" be "C."

Further, as illustrated in FIG. 2, let a distance from a roll center "P" of a final 3-roll apparatus 4 disposed on an outlet side of a sizing apparatus 1 to a beginning end 50*a* of a parallel inner wall surface 55 of a guide bore 50 be "Y1," a distance from the roll center "P" to a terminal end 50*b* of the parallel inner wall surface 55 of the guide bore 50 be "Y2," and a difference between an outer diameter of the sized steel stock "W" and an inner diameter of the guide bore 50 be "2X." Hereinafter, "2X" ( i.e., a product of 2 and "X") shall denote the difference, and a simple "X" shall denote a clearance between the sized steel stock "W" and the guide bore 50. Furthermore, in FIG. 2, a center "CP" between 3 sizing rolls 41 is disposed on an extension line from an axial center line of the guide bore 50.

Under these circumstances, in accordance with the first external force application form described above, an external force "F1" can be applied to the leading end "WO" of the steel stock "W" which is about to bend by bringing the leading end "WO" of the steel stock "W" into contact with the inner wall surface 55 of the guide bore 50 as illustrated in FIG. 2 during an early period when a "J" shape bending resulting from the action of the 3-roll 4 is about to occur, and accordingly the bending amount of the first bending "W1" can be relieved. Thus, the leading end "WO" of the steel stock "W" is regulated as described above, and accordingly, as illustrated in FIG. 3, the first bending "W1" is bent in an opposite direction against its original bending direction.

Also under the aforementioned circumstances, in accordance with the second external force application form described above, an external force "F1" can be applied to the leading end "WO" of the steel stock "W" by bringing the leading end "WO" of the steel stock "W" into contact with an inner wall surface portion 55*h* of the guide bore 50, and at the same time an external force "F2" can be applied to the steel stock "W" by bringing the first bending "W1" into contact with an inner wall surface portion 55*i* as illustrated in FIG. 3 when the steel stock "W" enters the guide bore 50. With these force applications, the external force "F1" and the external force "F2" face and act in directions opposite to each other. Hence, the bending amount of the first bending "W1" can be reduced, and consequently the first bending "W1" can be corrected effectively.

The present invention has been developed in accordance with the recognition of the first and the second external force application forms described above.

A steel stock shaping apparatus according to the present invention is adapted for sizing a steel stock having a round shape or a hexagonal shape in a transverse cross section, and it comprises:

a sizing apparatus including a plural set of 3-roll apparatuses disposed in series in a steel stock transferring direction and causing an "S" shape bending at a leading end of a steel stock during sizing, the 3-roll apparatuses including 3 sizing rolls having a caliber groove surface going therearound in a ring shape and disposed at predetermined intervals in a circumferential direction of the steel stock; and a guide apparatus disposed adjacent to an outlet of the sizing apparatus and including a guide bore adapted for guiding a sized steel stock discharged from the outlet of the sizing apparatus, an inner diameter of the guide bore adjusted so as to be greater than an outer diameter of the steel stock in an amount of 0.1 to 8 mm.

A steel stock shaping process according to the present invention employs:

a sizing apparatus including a plural set of 3-roll apparatuses disposed in series in a steel stock transferring direction and causing an "S" shape bending at a leading end of a steel stock during sizing, the 3-roll apparatuses including 3 sizing rolls having a caliber groove surface going therearound in a ring shape and disposed at predetermined intervals in a circumferential direction of the steel stock; and a guide apparatus disposed adjacent to an outlet of the sizing apparatus and including a guide bore adapted for guiding a sized steel stock discharged from the outlet of the sizing apparatus; and it comprises the steps of:

sizing a rolled steel stock on the outer peripheral portion with the caliber groove surfaces of the sizing rolls of the sizing apparatus; and inserting a sized steel stock into the guide bore of the guide apparatus;

wherein correcting the bending by pressing and bringing a leading end of the steel stock into contact with an inner wall surface of the guide bore during an initial period when the leading end of the steel stock begins to pass through the guide bore.

In the present steel stock shaping apparatus and process, the guide apparatus is adapted to accurately guide the steel stock to a subsequent process. As far as the above-mentioned difference or clearance setting range is maintained, the half of the difference between an outer diameter of the steel stock and an inner diameter of the guide bore, or the clearance (i.e., "X"), can be determined depending on the specific outside diameters of the steel stocks. In the case that the clearance is decreased, the bending of the steel stock collides with the inner wall surface of the guide bore earlier. Thus, there are provided an advantageous effect that the bending is corrected earlier. On the contrary, when a variety of steel stocks having different outer diameters should be sized, the guide apparatus should be exchanged with other guide apparatuses depending on the outer diameters of the steel stocks. Accordingly, the decreased clearance is disadvantageous in view of productivity. On the other hand, in the case that the clearance is increased, it is not necessary to exchange the guide apparatus with the other guide apparatuses even when a steel stock which has a different outer diameter from that of the previous steel stock should be sized. Accordingly, the increased clearance is advantageous in view of productivity. However, there occurs retardation in the timing where the steel stock contacts with the inner wall surface of the guide bore, and accordingly the bending correctability deteriorates more or less. In view of these circumstances, it is needed to set the half of the difference between an outer diameter of the steel stock and an inner diameter of the guide bore, or the clearance (i.e., "X"), so as to fall in the aforementioned difference or clearance setting range.

In addition, in an "S" shape bending which occurs at a leading end of a steel stock during sizing with the sizing apparatus of the steel stock shaping apparatus according to the present invention, let a distance from a leading end of the steel stock to a first bending be "L1" in a steel stock transferring direction, let a bending amount of the first bending be "A," let a distance from a roll center of a final 3-roll apparatus disposed on an outlet side of the sizing apparatus to a beginning end of a parallel inner wall surface of the guide bore be "Y1" in the steel stock transferring direction, let a distance from the roll center to a terminal end of the parallel inner wall surface of the guide bore be "Y2" in the steel stock transferring direction, and let the difference between an outer diameter of the sized steel stock and an inner diameter of the guide bore be "2X" (i.e., a product of 2 and "X" where "X" is the clearance), these values are set so that "Y1" is smaller than "L1," "Y2" is larger than "L1," and "X" is "A" or less.

Further, in the steel stock shaping apparatus according to the present invention, the inner wall surface forming the guide bore can be constructed so that it is displaceable in a radial direction. If such is the case, the clearance "X," or the half of the difference between the inner diameter of the guide bore and the outer diameter of steel stock, can be made variable.

Furthermore, the steel stock shaping apparatus according to the present invention is adapted for sizing a steel stock having a round shape or a hexagonal shape in a transverse cross section, and it can be constructed as follows:

a sizing apparatus including a plural set of 3-roll apparatuses disposed in series in a steel stock transferring direction and causing an "S" shape bending at a leading end of a steel stock during sizing, the 3-roll apparatuses including 3 sizing rolls having a caliber groove surface going therearound in a ring shape and disposed at predetermined intervals in a circumferential direction of the steel stock; and a guide apparatus disposed adjacent to an outlet of the sizing apparatus, adapted for guiding a sized steel stock discharged from the outlet of the sizing apparatus, and including;

a guide body including a plurality of divided guide bodies, the divided guide bodies forming a guide bore, divided in a circumferential direction around an axial line of the steel stock and disposed in a displaceable manner in a centripetal direction; and an urging member adapted for urging the divided guided members in a centripetal direction so as to approach inner wall surfaces of the divided guide bodies to the steel stock or bring the inner wall surfaces of the divided guide bodies into contact with the steel stock.

If the present steel stock shaping apparatus is constructed as described above, the number of the divided guide bodies constituting the guide bore can be determined as the respective case requires, and they can be disposed in a radial manner around an axial line of the steel stock. As the urging member, it is possible to employ a variety of springs such as a plate spring, a coned disk spring, a helical spring, or the like, and a foamed body. A spring constant of the urging member can be determined as the respective case requires. For instance, in the case that the spring constant is increased, the spring characteristic of the urging member becomes stiff, and consequently it is possible to heavily bring the inner wall surfaces of the divided guide bodies into contact with the steel stock when there arises the bending in the steel stock.

Moreover, the present steel stock shaping apparatus can be constructed as follows. Namely, the guide apparatus is held by the sizing apparatus so that the guide apparatus can adjust its position in a direction in which the 3-roll apparatuses are disposed in series. If the present steel stock shaping apparatus is constructed in this manner, the guide apparatus can approach to the outlet side 3-roll apparatus when its position is adjusted.

In addition, in the steel stock shaping apparatus according to the present invention, the guide apparatus can be constructed so that it includes a plurality of guide bodies having a guide bore and that the guide bodies are disposed in series in proximity to each other or in contact with each other in a direction in which the 3-roll apparatuses are disposed in series.

In particular, in the steel stock shaping apparatus according to the present invention, the guide apparatus can be constructed so that it includes an inner member having a solid lubricant property or a wear resistance and having a guide bore as well, and an outer member holding the inner member.

As for a material for forming the inner member constituting the guide bore, it is possible to employ at least one selected from the group consisting of carbon cast iron, general-purpose cast iron having graphite flake, ductile cast iron having spheroidal graphite, ceramics such as alumina, silicon nitride or the like, and carbide, all of which possess a solid lubricant property and a wear resistance.

The operations and the advantageous effects of the present invention will be described hereinafter. In the present invention, since the clearance between the outer surface of the steel stock and the inner wall surface of the guide bore of the guide apparatus is diminished or there is provided no clearance between them substantially, the bending which occurs when the steel stock passes through the guide bore can be corrected during an early stage. As a result, the steel stock bending amount can be reduced accordingly.

In particular, in the case that the material forming the inner wall surface of the guide bore has a lubricant property or a wear resistance, scratches or the like can be inhibited from occurring. The scratches or the like are caused on the steel stock by the contact, the seizure, and so on, between the inner wall surface and the steel stock.

Further, in the ease that the size of the clearance is made adjustable depending on the diameters of the steel stocks, one guide apparatus can cope with a wide variety of the steel stocks having various diameters.

Furthermore, in the case that the divided guide bodies are urged by the urging member in a centripetal direction, it is possible to contact the inner wall surfaces of the divided guide bodies with or approach them to the steel stock. Consequently, this construction is advantageous for diminishing the clearance.

Moreover, in the case that the guide apparatus is made so that it can adjust its position in a direction in which the 3-roll apparatuses are disposed in series, the guide apparatus can approach to the outlet side 3-roll apparatus when its position is adjusted. Hence, the bent portion of the steel stock can be brought into contact with the inner wall surface forming the guide bore in an earlier stage when the bending is about to arise in the steel stock, and accordingly the external force can be applied to the steel stock in the earlier stage.

In addition, in the case that the guide apparatus is made approachable to the outlet side 3-roll apparatus, the following operations can be achieved. Namely, in FIG. 2, let a depressing point be "K" where the steel stock "W" is depressed by the sizing roll 41 of the 3-roll 4, and let a contact point be "M" where the bent leading end "WO" of the steel stock "W" is brought into contact with the inner wall surface 55 of the guide bore 50. In order to inhibit the steel stock "W" from deforming during the correction of the bending, it is preferable that a distance between "K" and "M" is shorter in a steel stock transferring direction. When the guide hole 50 approaches to the depressing point "K" of the 3-roll apparatus 4, the contact point "M" approaches to the depressing point "K," thereby enabling to shorten the distance between "M" and "K." Accordingly, such an arrangement is advantageous for inhibiting the steel stock "W" from deforming, and it is appropriate for precision rolling. Additionally, the arrangement makes it possible to bring the leading end "WO" of the steel stock "W" into contact with the inner wall surface 55 of the guide bore 50 during an initial bending stage where the leading end "WO" of the steel stock "W" is bent in an extremely small amount. Consequently, it is possible to reduce the clearance "X" by the reduction of the distance between "K" and "M."

Finally, in the case that a plurality of guide bodies having a guide bore are disposed in series in proximity to each other or in contact with each other in a direction in which the 3-roll apparatuses are disposed in series, it is possible to prolong a length of the guide bore in the axial direction by disposing the guide bodies in such a manner. As a result, it is possible to deal with cases where the lengths of the letter "S" shape bendings are long.

As having been described so far, in accordance with the steel stock shaping apparatus or the steel stock shaping process according to the present invention, it is possible to relieve or avoid the letter "S" shape bending at the leading end of the steel stock. Thus, since the present apparatus or process inhibits the transfer troubles from arising in the subsequent processes and they obviate the cutting of the leading end, it is possible to improve the material loss.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIGS. 1 through 8 relate to a First Preferred Embodiment according to the present invention, wherein:

FIG. 1 is a schematic view which illustrates a bending occurred in a steel stock;

FIG. 2 is a schematic view which illustrates a leading end of the steel stock brought into contact with an inner wall surface of a guide bore;

FIG. 3 is a schematic view which illustrates the leading end of the steel stock bent in a letter "S" shape and brought into contact with the inner wall surface of the guide bore;

FIG. 4 is a perspective view which illustrates an outline construction of the First Preferred Embodiment of a steel stock shaping apparatus according to the present invention;

FIG. 5 is a side view of the First Preferred Embodiment of the present steel steel stock shaping apparatus;

FIG. 6 is a front view of a third 3-roll apparatus of a sizing apparatus in the First Preferred Embodiment of the present steel stock shaping apparatus;

FIG. 7 is an enlarged cross sectional view of a guide apparatus in the First Preferred Embodiment of the present steel steel stock shaping apparatus; and FIG. 8 is a graphic representation which illustrates results of a measurement on bendings occurred in steel stocks;

FIGS. 11 and 12 relate to a Third Preferred Embodiment according to the present invention, wherein:

FIG. 11 is a cross sectional view which illustrates a guide apparatus relating to the Third Preferred Embodiment; and FIG. 12 is a cross sectional view taken along the line A—A in FIG. 11;

BEST MODE FOR CARRYING OUT THE INVENTION

Having generally described the present invention, a further understanding can be obtained by reference to the specific preferred embodiments which are provided herein for purposes of illustration only and are not intended to limit the scope of the appended claims.

First Preferred Embodiment

A steel stock shaping apparatus according to the present invention will be hereinafter described with reference to a First Preferred Embodiment which is illustrated in FIGS. 1 through 8.

First of all, an overall construction of the steel stock shaping apparatus will be described with reference to FIGS. 4 and 5. A sizing apparatus 1 is included in this steel stock shaping apparatus. This sizing apparatus 1 is employed to process a steel stock "W" which is rolled to have a round shape with an extremely high roundness, and it is adapted for sizing the steel stock "W" so as to further upgrade the dimensional accuracy and the roundness accuracy.

Figure 4:
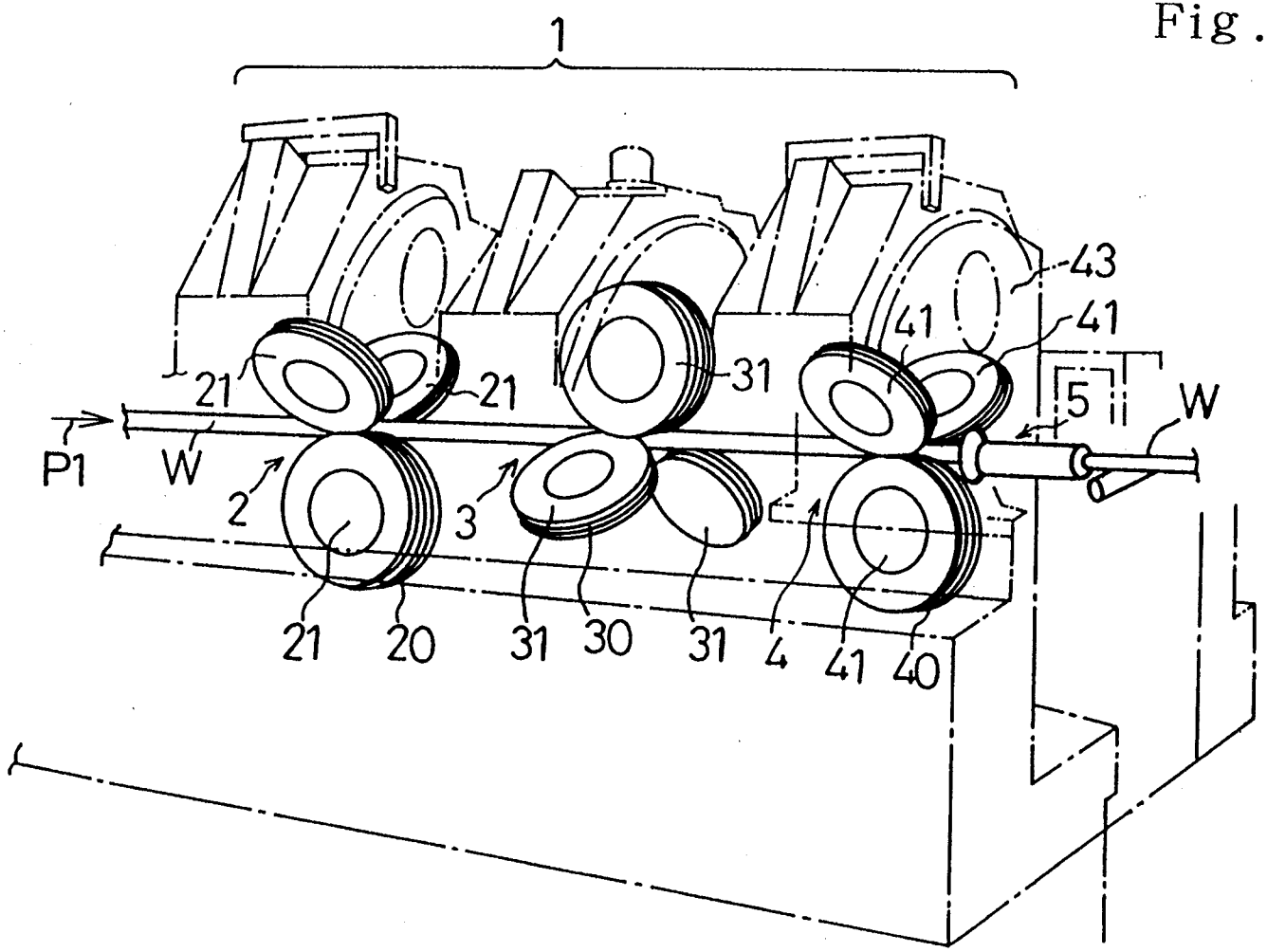
Figure 5:
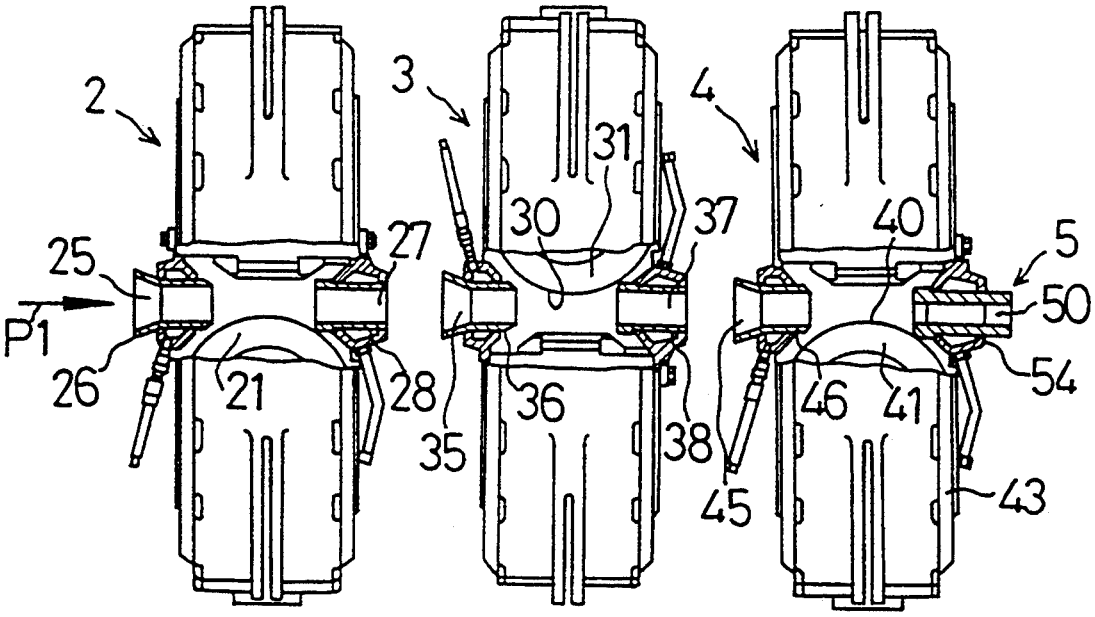
Figure 6:
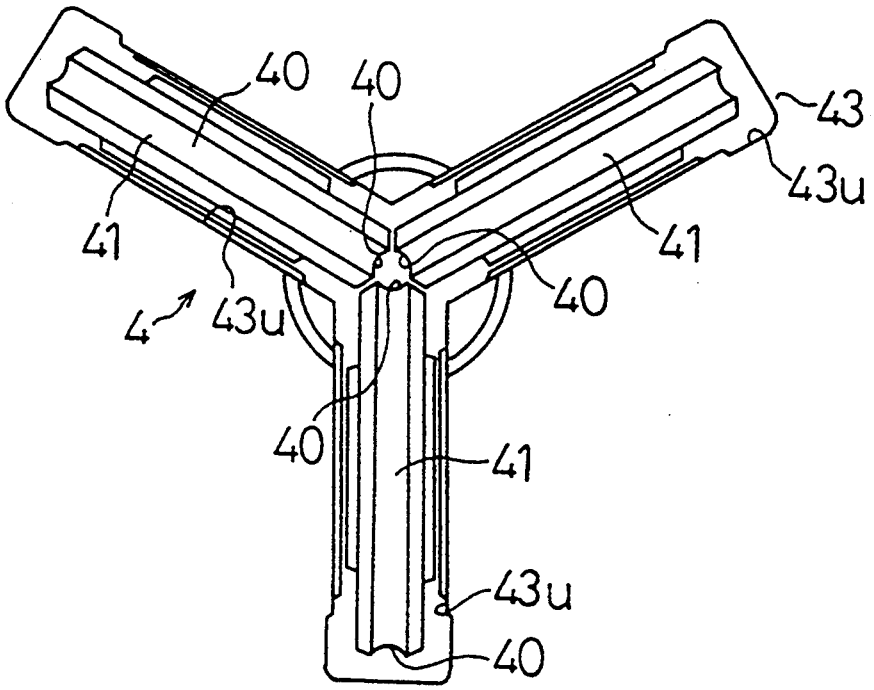

As illustrated in FIGS. 4 and 5, the sizing apparatus 1 includes an inlet side first 3-roll apparatus 2, a second 3-roll apparatus 3 and an outlet side third 3-roll apparatus 4 which are disposed in this order in series in a steel stock "W" transferring direction "P1." Moreover, as illustrated in FIG. 6, the third 3-roll apparatus 4 includes three disk shaped sizing rolls 41 which have a caliber groove surface 40 going therearound in a ring shape and which are disposed at intervals of 120° in a circumferential direction of the steel stock "W." The sizing rolls 41 are made of ductile cast iron, and the caliber groove surfaces 40 have a basic dimension of "D10" at the caliber bottoms. In FIG. 6, portions designated with 43*u* are vacancies which are formed in a stand 43 of the third 3-roll apparatus 4.

The second 3-roll apparatus 3 has a construction similar to that of the third 3-roll apparatus 4 basically, and it includes three disk shaped sizing rolls 31 which have a caliber groove surface 30 going therearound in a ring shape and which are disposed at intervals of 120° in a circumferential direction of the steel stock "W." The sizing rolls 31 are also made of ductile cast iron, and the caliber groove surfaces 30 have a basic dimension of "D11" at the caliber bottoms. However, the three sizing rolls 31 of the second 3-roll apparatus 3 are disposed in a phase which is different from that of the sizing rolls 41 of the third 3-roll apparatus 4.

The first 3-roll apparatus 2 has a construction similar to that of the third 3-roll apparatus 4 basically, and it includes three disk shaped sizing rolls 21 which have a caliber groove surface 20 going therearound in a ring shape and which are disposed at intervals of 120° in a circumferential direction of the steel stock "W." The sizing rolls 21 are also made of ductile cast iron, and the caliber groove surfaces 20 have a basic dimension of "D12" at the caliber bottoms. In this first 3-roll apparatus 2, however, the three sizing rolls 20 are disposed in a phase which is equal to that of the sizing rolls 41 of the third 3-roll apparatus 4. The dimensions "D10" through "D12" are 492 mm basically, but they enlarge by trace dimensions as they go down from "D12," "D11" to "D10" in this order.

As illustrated in FIG. 5, in the first 3-roll apparatus 2, there are provided a cylinder shaped inlet side guide apparatus 26 having a guide bore 25 and a cylinder shaped outlet side guide apparatus 28 having a guide bore 27 at the inlet side and the outlet side, respectively. Also, in the second 3-roll apparatus 3, there are provided a cylinder shaped inlet side guide apparatus 36 having a guide bore 35 and a cylinder shaped outlet side guide apparatus 38 having a guide bore 37 at the inlet side and the outlet side, respectively. Also, in the third 3-roll apparatus 4, there are provided a cylinder shaped inlet side guide apparatus 46 having a guide bore 45 and a cylinder shaped outlet side guide apparatus 5 having a guide bore 50 at the inlet side and the outlet side, respectively.

Figure 7:
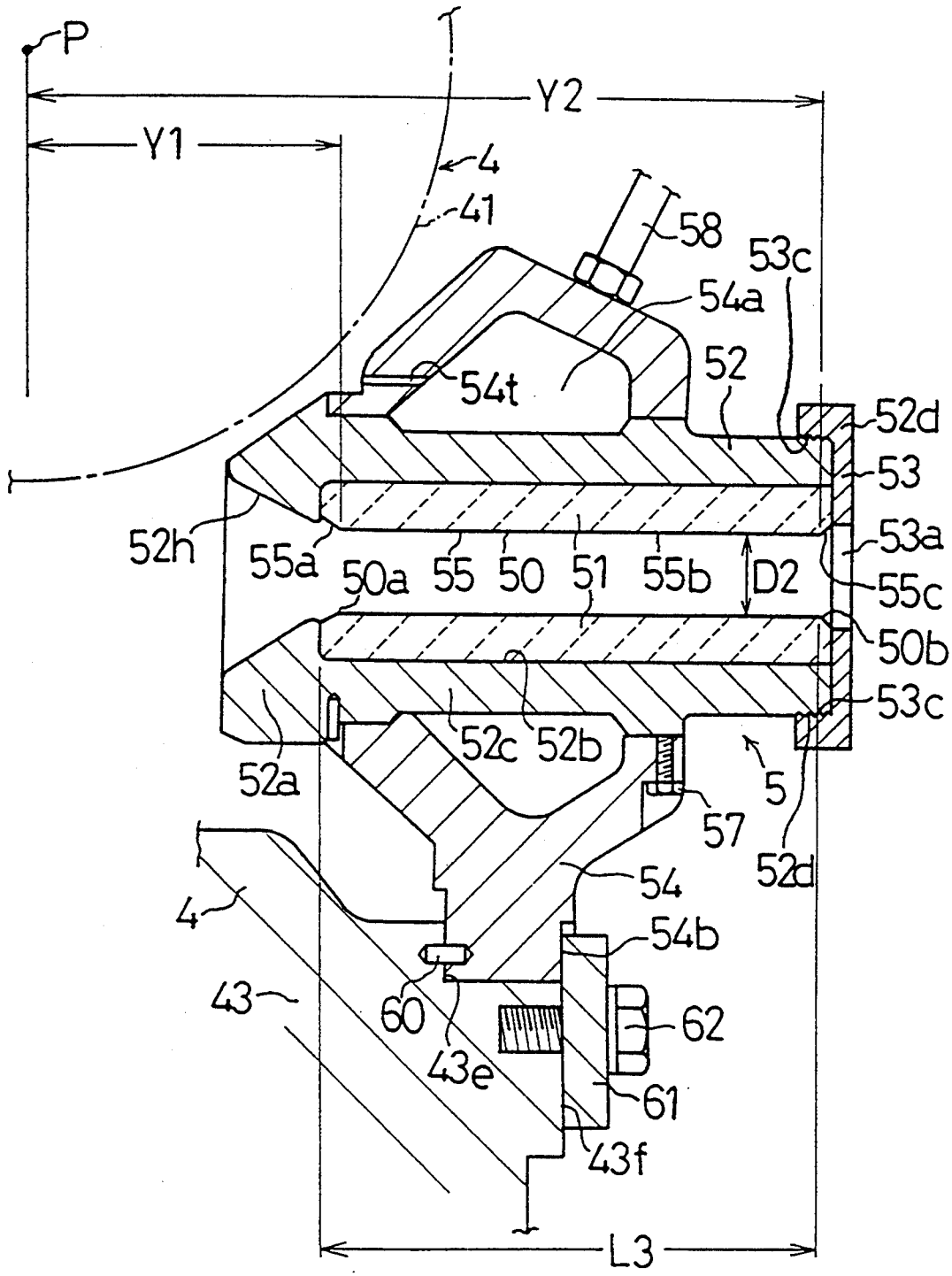

This First Preferred Embodiment is characterized by the guide apparatus 5. As illustrated in FIG. 7, this guide apparatus 5 comprises a cylinder shaped inner member 51 which is adapted for working as a guide body having the cross-sectionally circle shaped guide bore 50, a cylinder shaped outer member 52 which is adapted for holding the inner member 51, a cover portion 53 which has a through hole 53*a*, a holder 54 which is adapted for fixing the outer member 52 to the stand 43 of the third 3-roll apparatus 4. The guide bore 50 is adapted for guiding the sized steel stock "W" which is discharged from the outlet of the third 3-roll apparatus 4, and it is disposed coaxially with an axial line of the steel stock "W" which travels through the third 3-roll apparatus 4. The inner member 51 is formed of a carbon material. At the front and rear of an inner wall surface 55 which is disposed parallelly with an axial center line of the inner member 51, there are disposed a conical inner wall surface 55*a* and a conical inner wall surface 55*c* communicating with the inner wall surface 55 in series. The outer member 52 is fixed to the holder 54 by a bolt 57. As illustrated in FIG. 7, the outer member 52 is formed of a steel (as per JIS S45C), and it includes a stopper cylinder portion 52*a* which has a cone-shaped guide surface 52*h* and a long cylinder portion 52*c* which has a parallel inner wall surface 52*b* disposed parallelly with an axial center line of the outer member 52. At the rear end of the long cylinder portion 52*c*, there is formed a male screw portion 52*d*. By screwing a female screw portion 53*c* of the cover portion 53 on the male screw portion 52*d* of the outer member 52, the cover portion 53 is coaxially fixed to the outer member 52. Thus, the cover portion 53 holds the inner member 51 in the outer member 52 in a state of a coming-off free. Further, the holder 54 is made of a cast steel, and it forms a water cooling chamber 54*a*. A water supply pipe 58 supplies water into the water cooling chamber 54*a*.

As having been described previously with reference to FIG. 1, in the bending occurred during the sizing with the sizing apparatus 1, let a distance from the leading end "WO" of the steel stock "W" to the first bending "W1" be "L1," and the bending amount of the first bending "W1" be "A." Further, as illustrated in FIG. 7, let the distance from the roll center "P" of the outlet side final third 3-roll apparatus 4 to the beginning end 50*a* of the inner wall surface 55 which is disposed parallelly with the axial center line of the guide bore 50 be "Y1," the distance from the roll center "P" to the terminal end 50*b* of the inner wall surface 55 which is disposed parallelly with the axial center line of the guide bore 50 be "Y2." Furthermore, the difference between the outer diameter of the sized steel stock "W" and the inner diameter of the guide bore 50 be "2X" (i.e., a product of 2 and "X" where "X" is the clearance). Under these dimensional circumstances, "Y1" is set so that it is smaller than "L1," "Y2" is set so that it is larger than "L1," and "X" is set so that it is "A" or less in this First Preferred Embodiment. Hence, as having been described previously with reference to FIGS. 2 and 3, it has been made possible to apply the external forces "F1" and "F2," which direct in opposite directions each other, to the steel stock "W," or it has been made possible to apply the external force "F1," which direct in one direction, to the steel stock "W" in certain cases.

Here, the holder 54 having the inner member 51 is fixed to the stand 43 as illustrated in FIG. 7, it is done as follows. Namely, a plate 61 is applied on a contact surface 54*b* of the holder 54 while the holder 54 is put into a swing-free state on an installation surface 43*e* of the stand 43 with a pin 60. While keeping these assembly state, the plate 61 is fixed to a plate installation surface 43*f* of the stand 43 with an installation bolt 62. The holder 54 is thusly fixed to the stand 43.

In this First Preferred Embodiment, a finish outside diameter dimension of the steel stock "W" after sizing is set at 38 mm, and the inside diameter of the inner wall surface 55 which is disposed parallelly with the axial center line of the guide bore 50 of the inner member 51 is set so that it is greater than the finish outside diameter dimension of the steel stock "W" by 0.1 to 8 mm. Therefore, the clearance between the inner wall surface 55 of the guide bore 50 and the outer surface of the steel stock "W" is as small as a half of the above-mentioned value (i.e., the half of the difference between the outside diameter of the steel stock "W" and the inside diameter of the inner wall surface 55), e.g., 0.05 to 4 mm. As representative examples of the dimensions, the inside diameter "D2" of the inner wall surface 55 of the guide bore 50 can be set at 43.5 mm, and the length dimension "L3" of the inner member 51 can be set at 180 mm.

Hereinafter, the sizing operation with the First Preferred Embodiment will be described. In the sizing operation, a hot steel stock "W" (as per JIS SCM420) is used. The steel stock "W" having temperatures of 850° to 1000° C. is inserted into the space between the rolls of the sizing apparatus 1. The cooling water supplied into the water cooling chamber 54*a* is spouted to the rolls through a water hole 54*t*. During the sizing operation, as can be understood from FIG. 5, the steel stock "W" is sized by the first 3-roll apparatus 2, the second 3-roll apparatus 3 and the third 3-roll apparatus 4 in this order. Also during the sizing operation, the steel stock "W" passes through the guide bore 25 of the inlet side guide apparatus 26, the guide bore 27 of the outlet side guide apparatus 28, the guide bore 35 of the inlet side guide apparatus 36, the guide bore 37 of the outlet side guide apparatus 38, the guide bore 45 of the inlet side guide apparatus 46 and the guide bore 50 of the guide apparatus 5 in this order in the direction of the arrow "P1."

Here, among the 3-roll apparatuses 2, 3 and 4 constituting the sizing apparatus 1 for sizing the steel stock "W," the depressing rate is set ultra small in the final third 3-roll apparatus 4, which is disposed mostly adjacent to the outlet side, in order to maintain the dimensional accuracy and the highly accurate roundness of the steel stock "W" as it is done conventionally. Accordingly, similarly to the conventional sizing apparatus, there are provided the sizing roll 41 whose caliber groove surface 40 is heavily brought into contact with the steel stock "W" and the sizing roll 41 whose caliber groove surface 40 is lightly brought into contact with the steel stock "W" in the three sizing rolls 4. In this arrangement, the sizing roll 41 whose caliber groove surface 40 is heavily brought into contact with the steel stock "W" extends the surface of steel stock "W," and its depressing reaches the central portions of the steel stock "W." On the other hand, the sizing roll 41 whose caliber groove surface 40 is lightly brought into contact with the steel stock "W" does not extend the surface of steel stock "W" substantially, and its depressing does not reach the central portions of the steel stock "W." Accordingly, there is the tendency that the leading end of the steel stock "W" bends in the letter "S" shape as it occurs conventionally.

For instance, in this First Preferred Embodiment, the overall surface area reduction rate is set at approximately 6% in the entire sizing apparatus 1. In the overall surface area reduction rate, the surface area reduction rate is set at approximately 3% in the first 3-roll apparatus 2, the surface area reduction rate is set at approximately 2% in the second 3-roll apparatus 3, and the surface area reduction rate is set at approximately 1% in the third 3-roll apparatus 4. Thus, the depressing rate is set ultra small in the third 3-roll apparatus 4.

Figure 8:
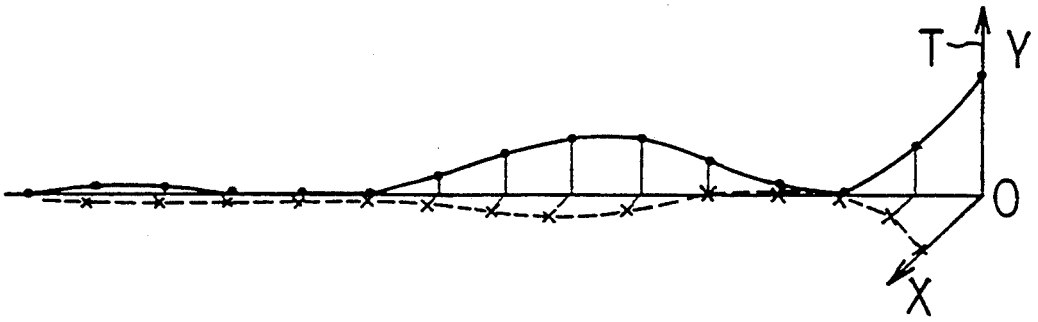

As having been described above, there is the tendency that the letter "S" shape occurs in the steel stock "W" which has passed through the sizing apparatus 1. FIG. 8 illustrates the letter "S" shape bending situation which is immediately after the steel stock "W" has passed through the third 3-roll apparatus 4 of the sizing apparatus 1. In FIG. 8, the solid-line curve specifies the measured values of the bending which were measured in the "Y" direction, and the broken-line curve specifies the measured values of the bending which were measured in the "X" direction. As illustrated in FIG. 8, it is possible to understand that there arose the three-dimensional letter "S" shape bending in the steel stock "W." In FIG. 8, however, the absolute values of "T" are omitted.

In this First Preferred Embodiment, the leading end "WO" of the sized steel stock "W" passes through the guide bore 50 of the guide apparatus 5, and further it is guided rearward by the sizing rolls 41. During the transfer operation, since the clearance between the inner wall surface 55 of the guide bore 50 and the outer surface of the steel stock "W" is as small as 0.05 to 4 mm, the steel stock "W" is corrected in an earlier stage when the bending of the steel stock "W" is small. Hence, the letter "S" shape bending is relieved in the steel stock "W."

In order to demonstrate the advantageous effect of the above-described First Preferred Embodiment over the conventional sizing apparatus in which the clearance was set at 14 mm when the diameter of the steel stock "W" was 38 mm, the dimensions illustrated in FIG. 1 were measured for the steel stocks "W" which were sized with the sizing apparatus 1 of the First Preferred Embodiment, and the results of the measurements are set forth in Table 1 below together with those measured for the steel stocks "W" which were sized with the conventional sizing apparatus. The number of the measured steel stocks "W" varied from 50 to 200 for both of the measurements, and the average values of the measured dimensions are set forth in Table 1. As set forth in Table 1, it was confirmed that the letter "S" shape bending at the leading end "WO" of the steel stock "W" sized with the sizing apparatus 1 of the First Preferred Embodiment was reduced sharply with respect to that of the steel stock "W" sized with the conventional sizing apparatus.

TABLE 1

In the case that the finish outside diameter of the steel stock "W" is 38 mm.

Unit: mm

| Dimensions | By Conventional Sizing Apparatus | By Sizing Apparatus 1 of 1st Preferred Embodiment |
|---|---|---|
| "A," Bending Amount of First Bending | 6.0 to 7.0 | 2.0 |
| "B," Bending Amount | 7.0 to 8.0 | 0.5 to 1.5 |
| "C," Bending Amount of Second Bending | 4.0 to 5.0 | 0.5 |
| "L1," Distance from Leading End to First Bending | 250 to 300 | 130 to 150 |
| "L2," Distance from Leading End to Terminal End of Second Bending | 900 | 550 |

Further, in the sizing apparatus 1 of this First Preferred Embodiment, a carbon material having a good lubrication property is used as a material for forming the inner member 51. Accordingly, it is possible to inhibit the scratches or the like, which result from the contact, the seizure and the like between the inner member 51 and the steel stock "W," from occurring.

Second Preferred Embodiment

Figure 9:
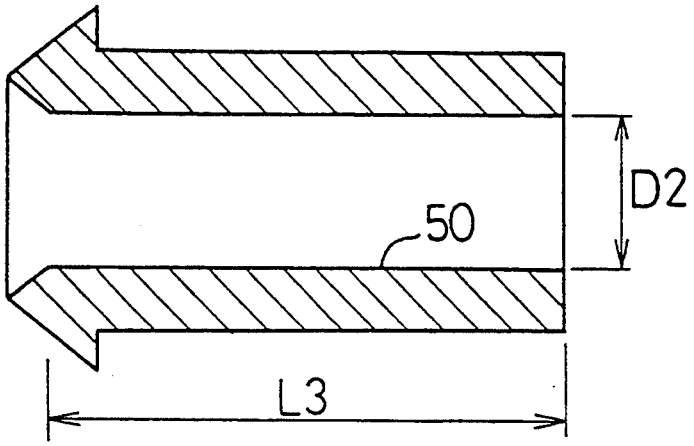
FIG. 9 is a cross sectional view which illustrates a guide apparatus relating to a Second Preferred Embodiment according to the present invention.

This Second Preferred Embodiment is characterized by a guide body having a form as illustrated in FIG. 9. In this Second Preferred Embodiment, the entire guide body was formed of gray pig iron (FC20-25 as per JIS). In the guide body, the inside diameter dimension "D2" of the guide bore 50 was set at 75.5 mm, the length dimension "L3" of the guide bore 50 was set at 150 mm, and the finish outside diameter dimension of the steel stock "W" was set at 70 mm.

Figure 1:
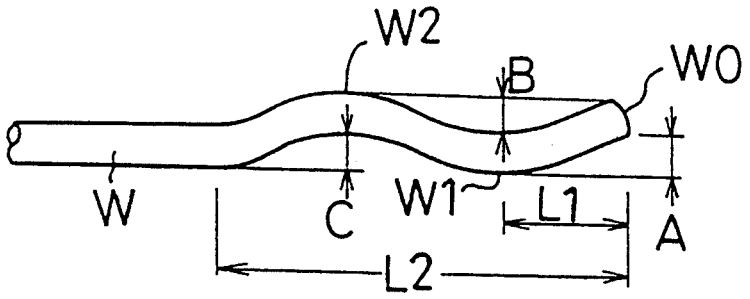
Figure 2:
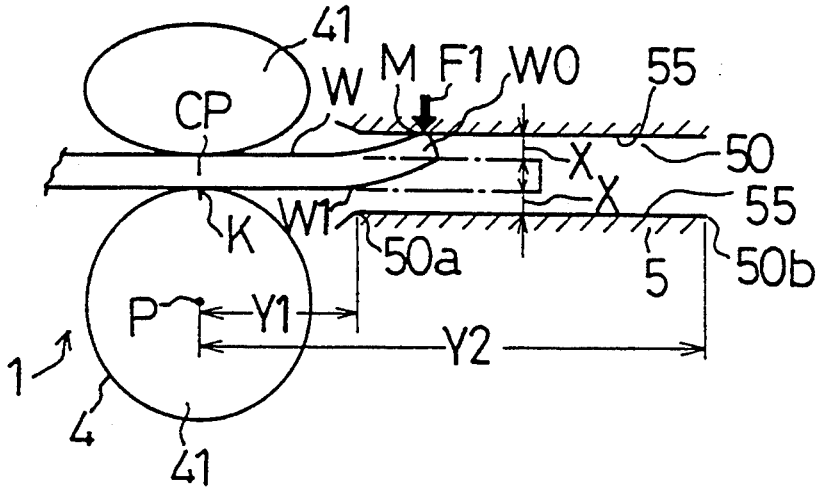
Figure 3:
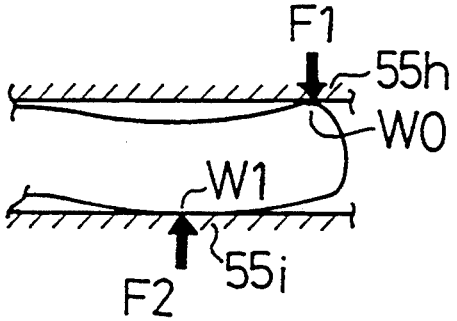

Then, in order to demonstrate the advantageous effect of the above-described Second Preferred Embodiment over the conventional sizing apparatus in which the clearance "X" was set at 18 mm when the finish outside diameter of the steel stock "W" was 70 mm, the dimensions illustrated in FIG. 1 were similarly measured for the steel stocks "W" which were sized with the Second Preferred Embodiment and the conventional sizing apparatus, and the results of the measurements are set forth in Table 2 below. The number of the measured steel stocks "W" were 150 to 200 for both of the measurements, and the average values of the measured dimensions are set forth in Table 2. Likewise, as set forth in Table 2, the letter "S" shape bending at the leading end "WO" of the steel stock "W" sized with the sizing apparatus 1 of the Second Preferred Embodiment was reduced sharply with respect to that of the steel stock "W" sized with the conventional sizing apparatus.

TABLE 2

In the case that the finish outside diameter of the steel stock "W" is 70 mm.

Unit: mm

| Dimensions | By Conventional Sizing Apparatus | By Sizing Apparatus 1 of 1st Preferred Embodiment |
|---|---|---|
| "A," Bending Amount of First Bending | 6.0 to 8.0 | 3.0 to 5.0 |
| "B," Bending Amount | 5.0 to 7.0 | 2.0 to 3.0 |
| "C," Bending Amount of Second Bending | 6.0 to 8.0 | 0.5 to 1.0 |
| "L1," Distance from Leading End to First Bending | 200 to 350 | 150 to 200 |
| "L2," Distance from Leading End to Terminal End of Second Bending | 900 | 550 |

Application Example

Figure 10:
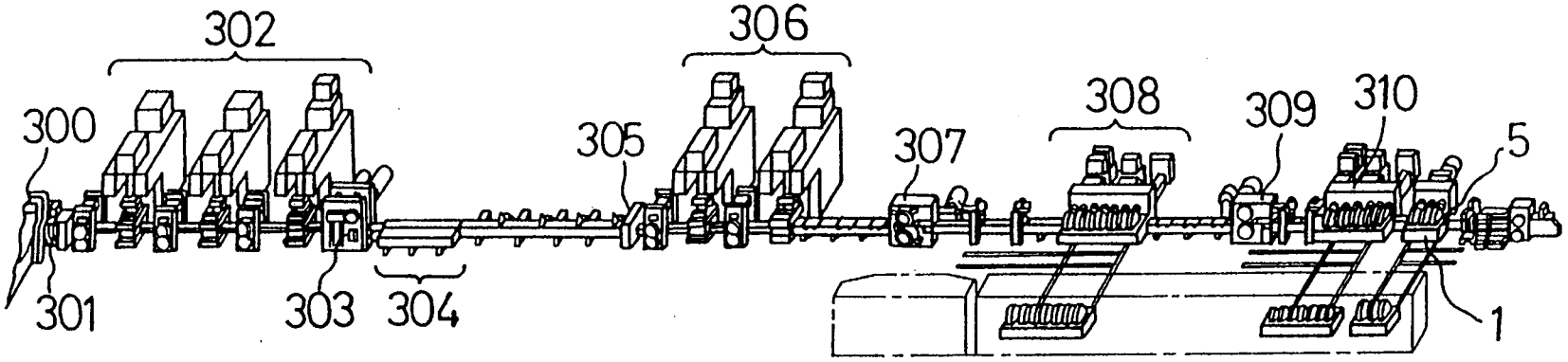
FIG. 10 is a perspective view which illustrates a precision rolling line provided with a steel stock shaping apparatus according to the present invention, the steel stock shaping apparatus incorporated as a final process thereof.

FIG. 10 illustrates an Application Example in which the above-described sizing apparatus 1 of the First or Second Preferred Embodiment is disposed in the final process of a ultra precision rolling process. The overall construction of the ultra precision rolling process will be hereinafter described with reference to FIG. 10. In this Application Example, the following constituent apparatuses are arranged in series in the following order: a walking-beam type heating furnace 300 adapted for heating steel stocks to approximately 800° to 1200° C., a de-scaling apparatus 301 adapted for removing oxide films on the steel stocks, an HV type rough rolling apparatus 302 adapted for roughly rolling the steel stocks, a flying type shearing apparatus 303 adapted for cutting the roughly rolled steel stocks, a rough roll water cooling band 304 adapted for on-line cooling the steel stocks for controlled rolling, a de-scaling apparatus 305, an HV type intermediate rolling apparatus 306 adapted for intermediately rolling the steel stocks, a flying type shearing apparatus 307, a 3-roll type intermediate rolling apparatus 308 including a maximum of seven 3-roll apparatuses disposed in line, a flying type shearing apparatus 309, a 3-roll type finish rolling apparatus 310 including a maximum of seven 3-roll apparatuses disposed in line and adapted for rolling the steel stocks to a highly accurate roundness, and the sizing apparatus 1 as well as the guide apparatus 5 according to either one of the First or Second Preferred Embodiment. In this Application Example, the 3-roll apparatuses are employed in the three consecutive processes, i.e., the intermediate rolling process, the finish rolling process and the sizing process, in order to roll the steel stocks "W" having the highly accurate dimensions and the high roundness.

Third Preferred Embodiment

Figure 11:
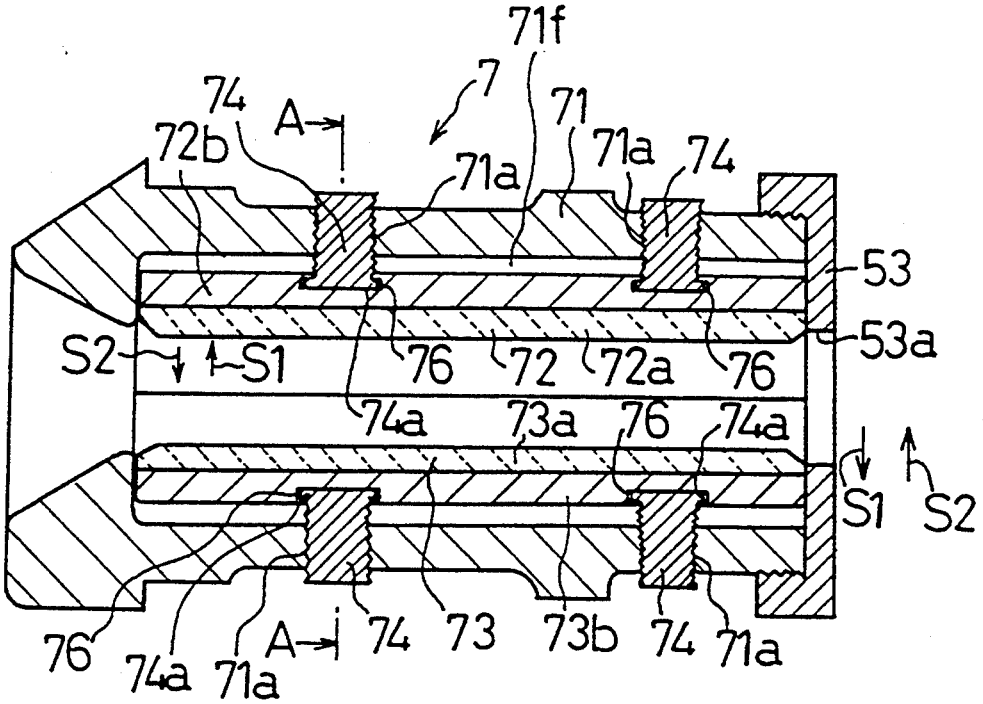
Figure 12:
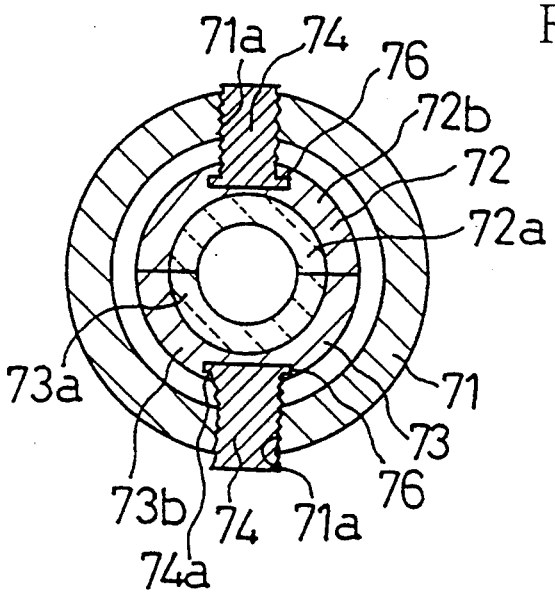

FIGS. 11 through 18 illustrate another preferred embodiments according to the present invention. For example, FIGS. 11 and 12 illustrate the Third Preferred Embodiment according to the present invention.

In this Third Preferred Embodiment, a guide apparatus 7 comprises a cylinder shaped outer member 71 which has a central bore 71*f*, a semi cylinder shaped upper guide body 72, a semi cylinder shaped lower guide body 73, and screws 74. Here, the upper guide body 72 and the lower guide body 73 work as a divided guide body.

The upper guide body 72 includes a semi cylinder shaped lubricant member 72*a* made of a carbon material, and a semi cylinder shaped rigid member 72*b* adapted for holding the lubricant member 72*a*. Likewise, the lower guide body 73 includes a semi cylinder shaped lubricant member 73*a* made of a carbon material, and a semi cylinder shaped rigid member 73*b* adapted for holding the lubricant member 73*a*. The screws 74 are screwed into screwed holes 71*a* in an advanceable and retractable manner. The screwed holes 71*a* are formed in the outer member 71 in the radial direction. Circle shaped leading ends 74*a* of the screws 74 are rotatably engaged with circle shaped engagement holes 76 of the rigid members 72*b* and 73*b*.

Thus, the upper guide body 72 and the lower guide body 73 can be displaced in the radial direction, i.e., in the directions of the arrows "S1" and "S2," by advancing or retracting the screws 74. Hence, in this Third Preferred Embodiment, it is possible to adjust the clearances between the steel stock "W" and the upper guide member 72 or the lower guide member 73.

Fourth Preferred Embodiment

Figure 13:
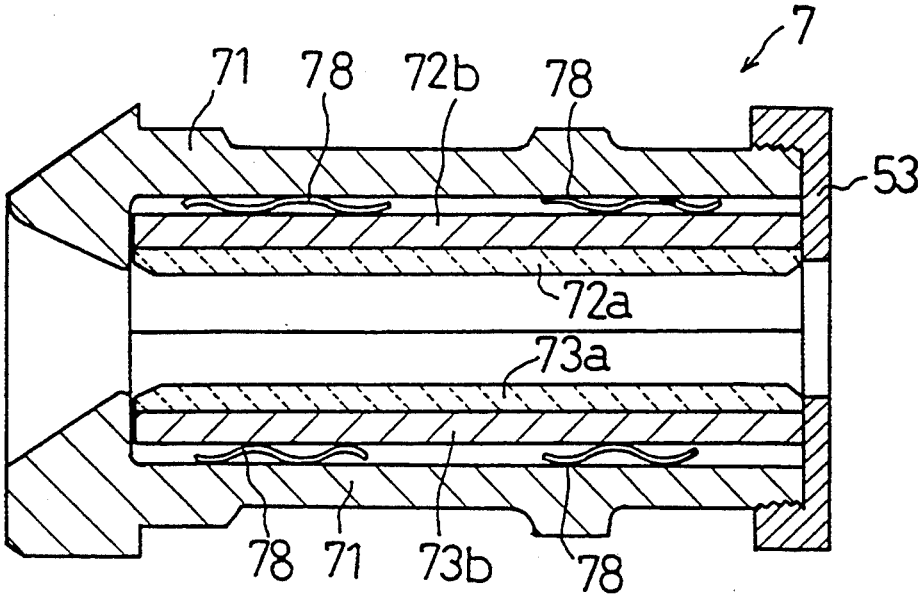
FIG. 13 is a cross sectional view which illustrates a guide apparatus relating to a Fourth Preferred Embodiment according to the present invention.

FIG. 13 illustrates the Fourth Preferred Embodiment according to the present invention. This Third Preferred Embodiment basically has a construction which is identical with that of the Third Preferred Embodiment illustrated in FIGS. 11 and 12. However, instead of the screws 74, there are provided plate springs 78 which intervene the boundary areas between an outer member 71 and rigid members 72*b* and 73*b*. The plate springs 78 have a relatively large spring constant, and they work as urging members. Accordingly, when the bending occurs in the steel stock "W," lubricant members 72*b* and 73*b* can be pressed onto the outer surface of the steel stock "W" against the spring forces of the plate springs 78. Here, since the spring constant of the plate springs 78 is large, the lubricant members 72*a* and 73*a* are pressed onto the leading end "WO" of the steel stock "W" even if the bent leading end "WO" of the steel stock "W" contacts the lubricant members 72*a* and 73*a*. Consequently, the bending of the steel stock "W" can be corrected by the lubricant members 72*a* and 73*a*.

Fifth Preferred Embodiment

Figure 14:
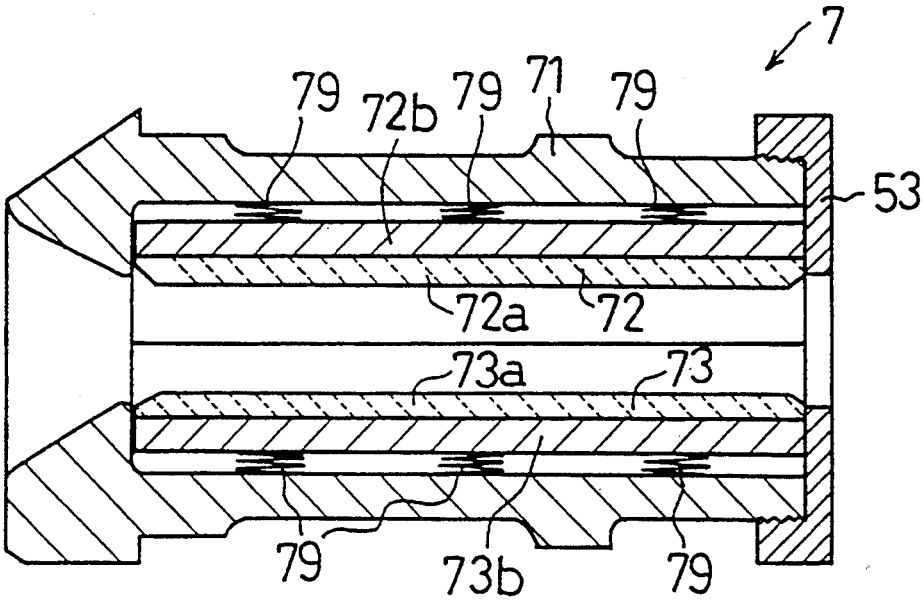
FIG. 14 is a cross sectional view which illustrates a guide apparatus relating to a Fifth Preferred Embodiment according to the present invention.

FIG. 14 illustrates the Fifth Preferred Embodiment according to the present invention. This Fifth Preferred Embodiment basically has a construction which is identical with that of the Fourth Preferred Embodiment illustrated in FIG. 13. However, instead of the plate springs 78, there are provided coil springs 79.

Also, in this Fifth Preferred Embodiment, when the bending occurs in the steel stock "W," lubricant members 72*b* and 73*b* can be pressed onto the outer surface of the steel stock "W" against the spring forces of the coil springs 79. Here, since the spring constant of the coil springs 79 is large, the bending of the steel stock "W" can be corrected by the lubricant members 72*a* and 73*a* even if the bent leading end "WO" of the steel stock "W" contacts the lubricant members 72*a* and 73*a*.

Sixth Preferred Embodiment

Figure 15:
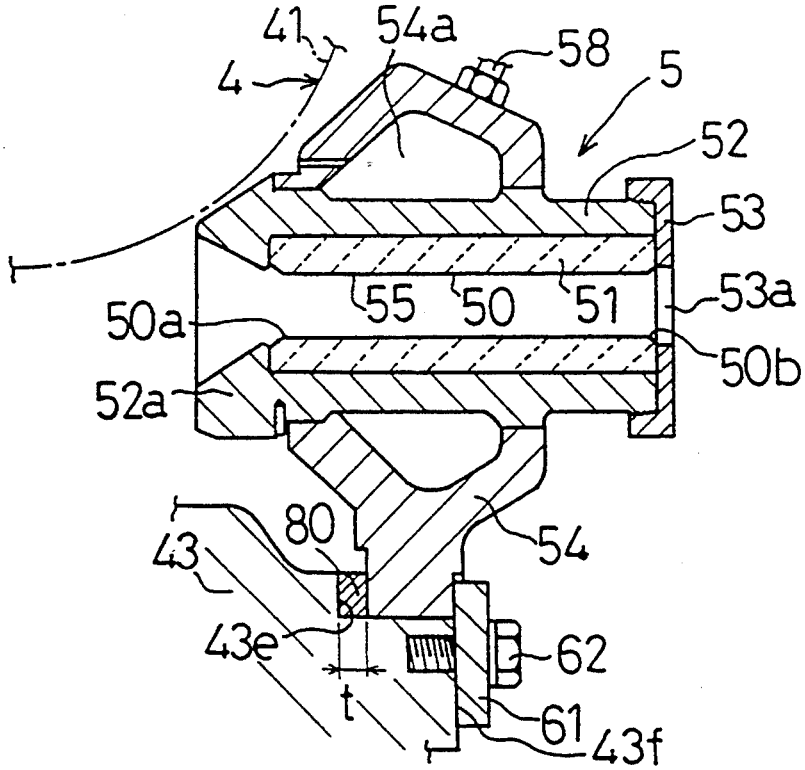
FIG. 15 is a cross sectional view which illustrates a guide apparatus relating to a Sixth Preferred Embodiment according to the present invention.

FIG. 15 illustrates the Sixth Preferred Embodiment according to the present invention. This Sixth Preferred Embodiment basically has a construction which is identical with that of the First Preferred Embodiment illustrated in FIG. 17. However, there is provided a spacer 80 which intervenes the space between a holder 54 of a guide apparatus 5 and an installation surface 43*e* of a stand 43. When various kinds of the spacers 80 whose thicknesses "t" vary each other are prepared, the guide apparatus 5 can be adjusted positionally with respect to the stand 43 of an outlet side 3-roll apparatus 4 in the steel stock transfer direction by replacing the spacer 80 with the other one.

Hence, it is possible to approach the guide apparatus 5 to the stand 43 of the 3-apparatus 4 depending on the bending circumstances occurred at the leading end "WO" of the steel stock "W." As a result, it is possible to correct the bending in a further earlier stage.

Seventh Preferred Embodiment

Figure 16:
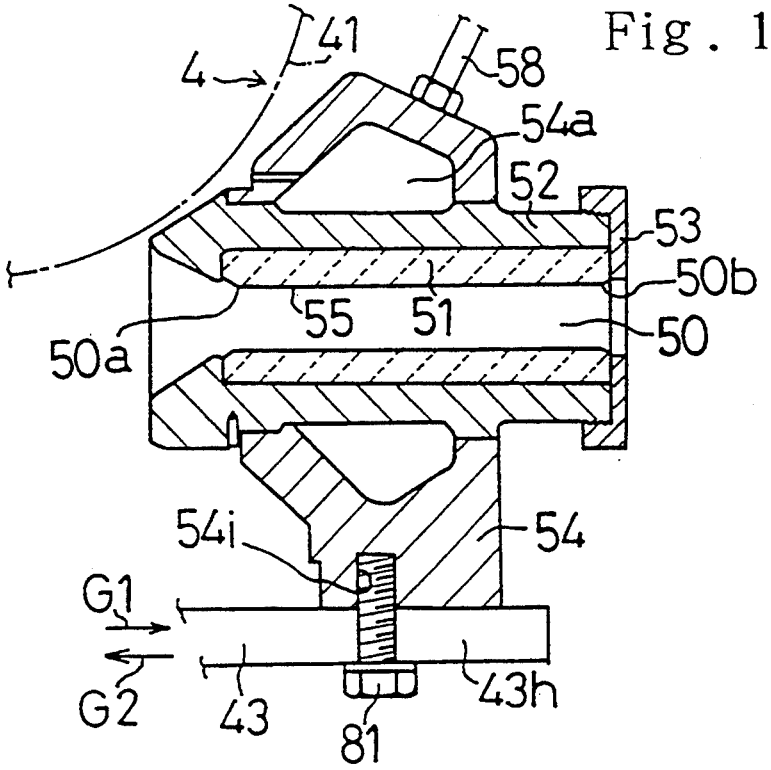
FIG. 16 is a cross sectional view which illustrates a guide apparatus relating to a Seventh Preferred Embodiment according to the present invention.

FIG. 16 illustrates the Seventh Preferred Embodiment according to the present invention. In this Seventh Preferred Embodiment, a guide groove 43*h* is formed in a guide 43 of an outlet side 3-roll apparatus 4 so as to extend in the directions of the arrows "G1" and "G2." A screw 81 is screwed in a screwed hole 54*i* of a holder 54 of a guide apparatus 5. The screw 81 can be loosened so as to transfer the holder 54 along the guide groove 43*h* in the steel stock transfer direction, namely in the direction of the arrow "G1" or "G2," and thereafter it is tightened.

Hence, the guide apparatus 5 can be adjusted positionally with respect to the stand 43 of the 3-roll apparatus 4. As a result, it is possible to approach the guide apparatus 5 to the stand 43 of the 3-apparatus 4 depending on the bending circumstances occurred in the steel stock "W."

Eighth Preferred Embodiment

Figure 17:
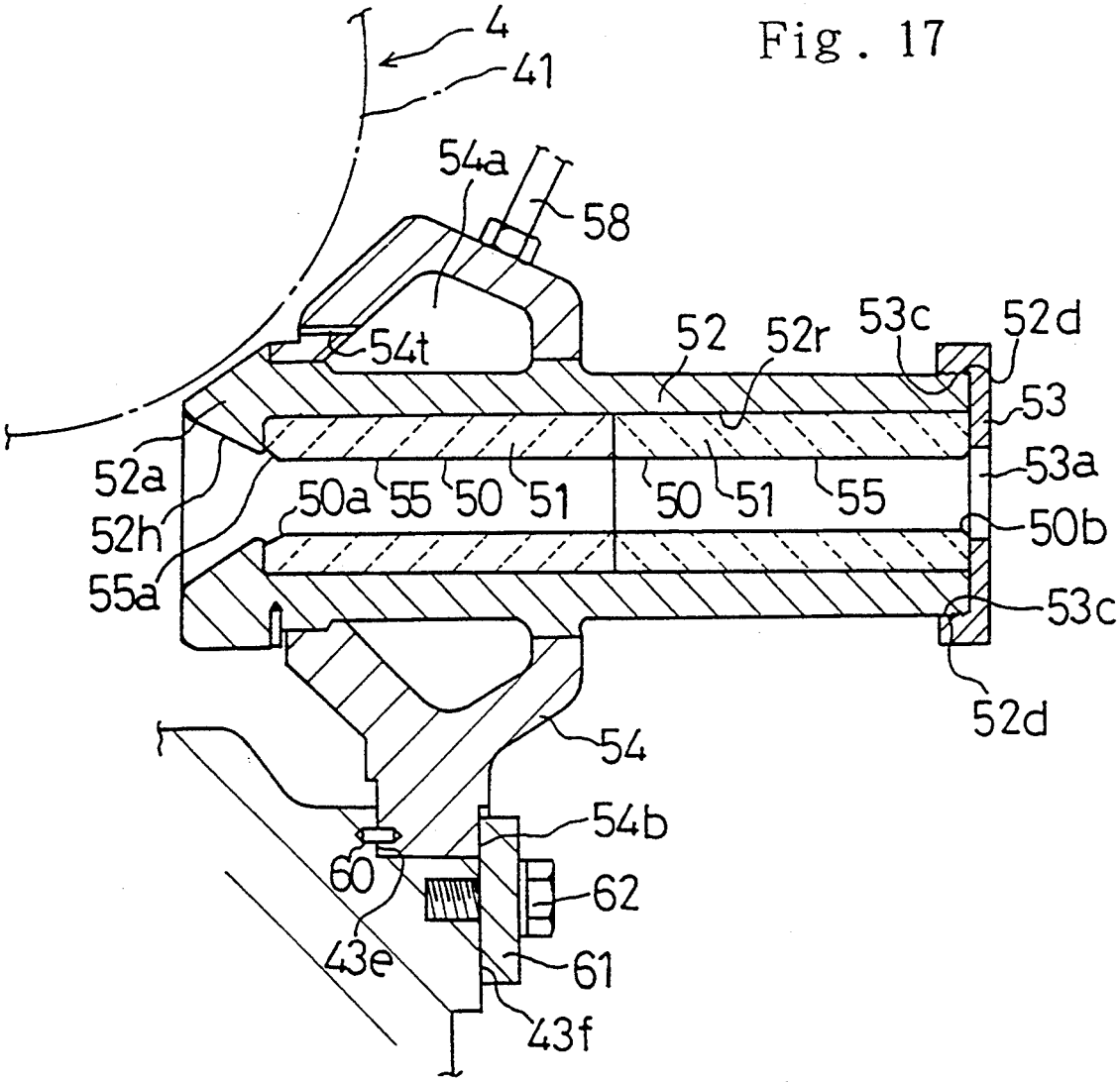
FIG. 17 is a cross sectional view which illustrates a guide apparatus relating to an Eighth Preferred Embodiment according to the present invention.

FIG. 17 illustrates the Eighth Preferred Embodiment according to the present invention. This Eighth Preferred Embodiment basically has a construction which is identical with that of the First Preferred Embodiment illustrated in FIG. 17. However, an outer member 52 of a guide apparatus 5 is designed so that its axial length is longer, and two inner members 51 are inserted into a bore 52*r* of the outer member 52 so that they contact with each other in series.

Hence, the construction of the Eighth Preferred Embodiment is advantageous for prolonging the axial length of the guide apparatus 5. Consequently, it is possible to correct the letter "S" shape bending even if the length of the bending is long. Moreover, this construction offers another advantageous effect that the inner members 51 can be replaced one by one when they broke.

Ninth Preferred Embodiment

Figure 18:
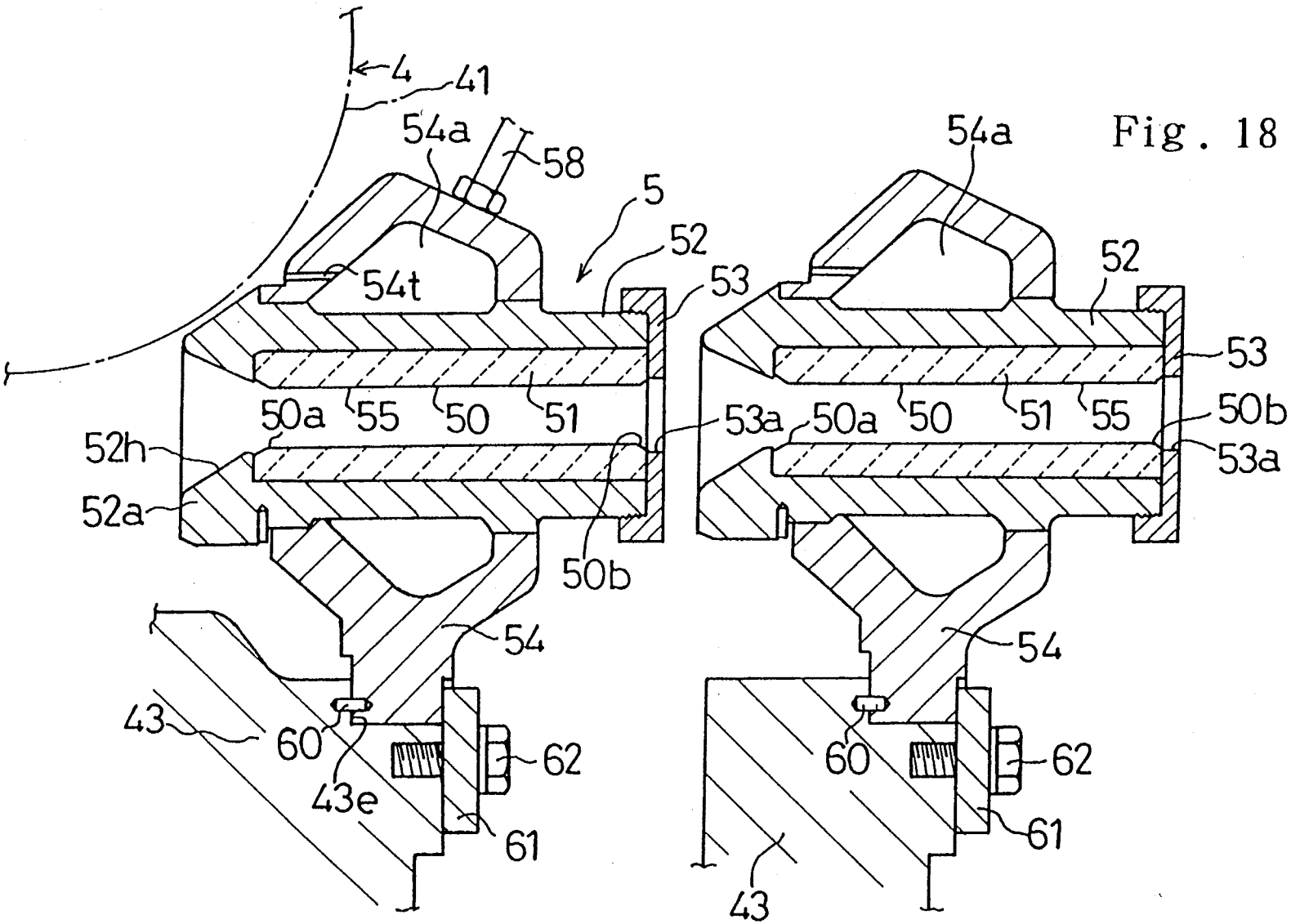
FIG. 18 is a cross sectional view which illustrates a guide apparatus relating to a Ninth Preferred Embodiment according to the present invention.

FIG. 18 illustrates the Ninth Preferred Embodiment according to the present invention. This Ninth Preferred Embodiment basically has a construction which is identical with that of the First Preferred Embodiment illustrated in FIG. 7. However, there are provided two guide apparatuses 5 in series, and each of the guide apparatuses 5 are fixed coaxially to a stand 43 of the outlet side 3-roll apparatus 4.

Hence, the construction of the Ninth Preferred Embodiment is advantageous for prolonging the overall axial length of the guide apparatuses 5. Consequently, it is possible to correct the letter "S" shape bending even if the length of the bending is long.

Industrial Applicability

As having been described so far, the steel stock shaping apparatus and the steel stock shaping process according to the present invention are appropriate for sizing steel stocks which are manufactured by precision rolling, ultra precision rolling, or the like so as to have the high dimensional accuracy.

Having now fully described the present invention, it will be apparent to one of ordinary skill in the art that many changes and modifications can be made thereto without departing from the spirit or scope of the present invention as set forth herein including the appended claims.

We claim:

1. A steel stock shaping apparatus adapted for sizing a steel stock having a round shape or a hexagonal shape in a transverse cross section, said apparatus comprising:

a sizing apparatus including plural sets of 3-roll apparatuses disposed in series in a steel stock transferring direction that cause an "S" shape bending at a leading end of a steel stock during sizing, the 3-roll apparatuses including a stand and 3 sizing rolls disposed in said stand, said 3 sizing rolls having a caliber groove surface going therearound in a ring shape and disposed at predetermined intervals in a circumferential direction of the steel stock, a surface area reduction rate of said steel stock is set less than 4% in a final one of said plural sets of 3-roll apparatuses, a guide apparatus having a sleeve-configuration, disposed adjacent to an outlet of said sizing apparatus and including a guide bore adapted for guiding a sized steel stock discharged from the outlet of said sizing apparatus, an inner diameter of the guide bore adjusted so as to be greater than an outer diameter of said steel stock in an amount of 0.1 to 8 mm, and a distance from said leading end of said steel stock to a first bending is "L1" in said steel stock transferring direction, a bending amount of the first bending in said "S" shape bending which occurs at said leading end of said steel stock during sizing with said sizing apparatus is "A", a distance from a roll center of said final 3-roll apparatus disposed on said outlet side of said sizing apparatus to a beginning end of a parallel inner wall surface of said guide bore is "Y1" in said steel stock transferring direction, a distance from the roll center to a terminal end of the parallel inner wall surface of said guide bore is "Y2" in said steel stock transferring direction, and a difference between an outer diameter of said sized steel stock and an inner diameter of said guide bore is a product of 2 and "X" where "X" is a clearance between said outer diameter of said sized steel stock and said inner diameter of said guide bore and "Y1" is smaller than "L1", "Y2" is larger than "L1", and "X" is "A" or less and "X" is in the range of 0.05 to 4 mm.

2. The steel stock shaping apparatus according to claim 1, wherein an inner wall surface forming said guide bore is made displaceable in a radial direction, and a clearance, defined as half of a difference between an inner diameter of said guide bore and an outer diameter of said steel stock, is made variable.

3. The steel stock shaping apparatus according to claim 1, wherein said guide apparatus includes an outer member having a central bore and a number of screw holes, divided guide bodies inserted into the central bore of the outer member and forming said guide bore, and a number of screws screwed in the screw holes in an advanceable and retractable manner and engaged with the divided guide bodies, whereby the divided guide bodies are made displaceable in the central bore of the outer member in a radial direction by advancing and retracting the screws.

4. The steel stock shaping apparatus according to claim 1, wherein a center between said 3 sizing rolls constituting an outlet side 3-roll apparatus is disposed on an extension line of an axial center line of said guide bore.

5. The steel stock shaping apparatus according to claim 1, wherein said sizing rolls are a disk type which has a caliber groove surface in an outer circumferential portion, said sizing rolls are disposed at intervals of approximately 120 degrees around said circumferential direction of said steel stock, and an inner wall surface of said guide bore is disposed parallelly with an axial center line of said guide bore.

6. The steel stock shaping apparatus according to claim 1, wherein there is a sizing roll which is heavily brought into contact with an outer surface of said steel stock in said three sizing rolls constituting an outlet side 3-roll apparatus of said sizing apparatus, and there is a sizing roll which is lightly brought into contact with an outer surface of said steel stock therein.

7. The steel stock shaping apparatus according to claim 1, wherein said sizing apparatus is disposed as a final process of a rolling process.

8. The steel stock shaping apparatus according to claim 1, wherein said guide apparatus is held by said sizing apparatus so as to be adjustable positionally in a direction in which said 3-roll apparatuses are disposed in series, whereby said guide apparatus is movable toward an outlet side 3-roll apparatus as it is adjusted positionally.

9. The steel stock shaping apparatus according to claim 1, wherein said guide apparatus includes two guide bodies having a guide bore, and the guide bodies are disposed in line in series so that they are in contact with each other in a direction in which said 3-roll apparatuses are disposed in series.

10. The steel stock shaping apparatus according to claim 1, wherein said guide apparatus includes an inner member which is made of a material having a solid lubricating property or a wear resistance property and which has a guide bore, an outer member which is adapted for holding the inner member, and a cover portion including a through hole disposed coaxially with said guide bore and having an inner diameter larger than an inner diameter of said guide bore, said cover portion holds said inner member in said outer member.

11. The steel stock shaping apparatus according to claim 10, wherein said inner member comprises at least one selected from the group consisting of a carbon material, a cast iron material, a ceramics material and a carbide material.

12. The steel stock shaping apparatus according to claim 10, wherein said stand of said sizing apparatus includes a holder and has a water cooling chamber between said holder and said guide apparatus for cooling said guide apparatus.

13. A steel stock shaping process, employing:

a steel stock having an outer diameter of less than 120 mm;

a sizing apparatus including plural sets of 3-roll apparatuses disposed in series in a steel stock transferring direction and causing an "S" shape bending at a leading end of a steel stock during sizing, the 3-roll apparatuses including a stand and 3 sizing rolls disposed in said stand, said 3 sizing rolls having a caliber groove surface going therearound in a ring shape and disposed at predetermined intervals in a circumferential direction of the steel stock, a surface area reduction rate is set less than 4% in a final one of said plural sets of 3-roll apparatuses; and a guide apparatus having a sleeve-configuration, disposed adjacent to an outlet of said sizing apparatus and including a guide bore adapted for guiding a sized steel stock discharged from the outlet of said sizing apparatus; and said process comprising the steps of:

sizing a rolled steel stock on an outer peripheral portion with said caliber groove surfaces of said sizing rolls of the sizing apparatus;

inserting a sized steel stock into said guide bore of said guide apparatus; and correcting said bending by pressing and bringing said leading end of said steel stock into contact with an inner wall surface of said guide bore during an initial period when said leading end of said steel stock begins to pass through said guide bore where a distance from said leading end of said steel stock to a first bending is "L1" in said steel stock transferring direction, a bending amount of the first bending in said "S" shape bending which occurs at said leading end of said steel stock during sizing with said sizing apparatus is "A", a distance from a roll center of said final 3-roll apparatus disposed on said outlet side of said sizing apparatus to a beginning end of a parallel inner wall surface of said guide bore is "Y1" in said steel stock transferring direction, a distance from the roll center to a terminal end of the parallel inner wall surface of said guide bore is "Y2" in said steel stock transferring direction, and a difference between an outer diameter of said sized steel stock and an inner diameter of said guide bore is a product of 2 and "X" where "X" is a clearance between said outer diameter of said sized steel stock and said inner diameter of said guide bore and "Y1" is smaller than "L1", "Y2" is larger than "L1" and "X" is "A" or less and "X" is in the range of 0.05 to 4 mm.

* * * * *